US005625176A

United States Patent [19]

Davis et al.

[11] Patent Number: 5,625,176

[45] Date of Patent: Apr. 29, 1997

[54] CROWD SERVICE ENHANCEMENTS WITH MULTI-DECK ELEVATORS

[75] Inventors: Anne R. L. Davis, Middlefield; Jannah Stanley, Cromwell; Daniel S. Williams, Meriden, all of Conn.

[73] Assignee: Otis Elevator Company, Farmington, Conn.

[21] Appl. No.: 494,906

[22] Filed: Jun. 26, 1995

[51] Int. Cl.[6] ..... B66B 1/20

[52] U.S. Cl. ..... 187/393; 187/387; 187/392; 187/902

[58] Field of Search ..... 187/902, 387, 187/385, 386, 392

[56] References Cited

U.S. PATENT DOCUMENTS

| | | | |
|---|---|---|---|
| 1,199,174 | 9/1916 | Gumpel . | |
| 4,582,173 | 4/1986 | Schröder | 187/29 |
| 4,632,224 | 12/1986 | Nowak et al. | 187/29 |
| 4,655,325 | 4/1987 | Schröder et al. | 187/127 |
| 4,708,224 | 11/1987 | Schroder | 187/125 |
| 4,836,336 | 6/1989 | Schroder | 187/121 |
| 4,926,976 | 5/1990 | Schroder | 187/125 |
| 4,993,518 | 2/1991 | van Straaten et al. | 187/127 |
| 5,022,497 | 6/1991 | Thangavelu | 187/124 |
| 5,024,295 | 6/1991 | Thanagevelu | 187/125 |
| 5,086,883 | 2/1992 | Schröder | 187/127 |
| 5,202,540 | 4/1993 | Aver et al. | 187/101 |
| 5,329,076 | 7/1994 | Kameli | 187/127 |
| 5,345,049 | 9/1994 | Bahjat et al. | 187/127 |
| 5,472,206 | 12/1995 | Powell et al. | 187/387 |

FOREIGN PATENT DOCUMENTS

| | | | |
|---|---|---|---|
| 2-265875 | 10/1990 | Japan | 187/902 |

*Primary Examiner*—Robert Nappi

[57] ABSTRACT

In an elevator dispatching system controlling the assignment of elevator cars in a building, a method of assigning a multi-deck elevator car includes determining if a crowd exists at a floor in the building; if it is determined that the crowd exists at the floor in the building, determining if two decks of a best elevator car are available; if it is determined that multiple decks of the best elevator car are available, assigning the two available decks of the best elevator to the floor where the crowd exists; wherein, the best elevator car makes one stop for each of the two available decks at the floor where the crowd exists.

4 Claims, 2 Drawing Sheets

CROWD SERVICE ENHANCEMENTS WITH MULTI-DECK ELEVATORS

TECHNICAL FIELD

The present invention relates generally to elevator systems and, in particular, relates to a dispatching system for multi-deck elevators.

BACKGROUND

Crowd sensors are installed in buildings at landings that have the potential for crowds to spontaneously and temporarily develop. The crowd sensors are used to provide information to a dispatch system indicating that the number of passengers waiting for a particular hall call cannot be serviced by the available space in an elevator assigned to service the passengers. In multi-deck elevator systems, the conventional method of servicing a crowd condition includes dispatching at least two elevators to the landing where the crowd is waiting. Although dispatching at least two elevators to a crowd has the advantage of providing improved service to the crowd, it has a detrimental effect on service and waiting times for passengers in the remainder of the building because fewer elevator cars are available to service the passengers in the remainder of the building.

DISCLOSURE OF THE INVENTION

It is an object of the present invention to reduce the detrimental effect on service and waiting times caused by dispatching several elevator cars to landings where a crowd exists.

It is another object of the present invention to reduce the number of car assignments if a false crowd is detected.

It is yet another object of the present invention to minimize the waiting time for a second car during a crowd condition.

It is still another object of the present invention to minimize passenger movement in the hallway.

According to the present invention, in an elevator dispaching system controlling the assignment of elevator cars in a building, a method of assigning a multi-deck elevator car includes determining if a crowd exists at a floor in the building; if it is determined that the crowd exists at the floor in the building, determining if two decks of a best elevator car are available; and if it is determined that two decks of the best elevator car are available, assigning the two available decks of the best elevator to the floor where the crowd exists; wherein, the best elevator car makes one stop for each of the two available decks at the floor where the crowd exists.

If it is determined that two decks of the best car are not available, the method may also include determining if an elevator car having two available decks exists; if the elevator car having two available decks exists, determining a best car having two available decks; determining if a response time of the best car having two available decks is acceptable; and if the response time of the best car having two available decks is acceptable, assigning the two available decks of the best elevator car having two available decks to the floor where the crowd exists; wherein, the best elevator car having two available decks makes one stop for each of the two available decks at the floor where the crowd exists.

If it is determined that the response time of the best car having two available decks is not acceptable, the method may also include determining if a next best elevator car having two decks available exists; if the next best elevator car having two available decks exists, determining if a response time of the next best elevator car having two available decks is acceptable; and if the response time of the next best elevator car having two available decks is acceptable, assigning the two available decks of the next best elevator car having two available decks to the floor where the crowd exists; wherein, the next best elevator car having two available decks makes one stop for each of the two available decks at the floor where the crowd exists.

The present invention provides the advantage of reducing the detrimental effect on service and waiting times caused by dispatching several elevator cars to a landing where a crowd exists by assigning two decks of a multi-deck elevator car to the floor where the crowd exists. As a result, more elevator cars are available to service passengers in the remainder of the building. Additionally, the present invention provides the advantage of reducing the number of car assignments if a false crowd, such as a large piece of equipment, is detected. Therefore, more elevator cars are available to service passengers in the remainder of the building during a false crowd condition. Furthermore, the present invention minimizes the waiting time for a second car during a crowd condition because of the relatively short arrival time between the two decks of the multi-deck elevator car assigned to service the crowd. The present invention also minimizes passenger movement in the hallway because the decks of the multi-deck elevator services the crowd from the same hallway entrance.

These and other features, aspects and advantages of the present invention will become better understood with regard to the following description, appended claims and accompanying drawings.

BEST MODE FOR CARRYING OUT THE INVENTION

Figure 1:
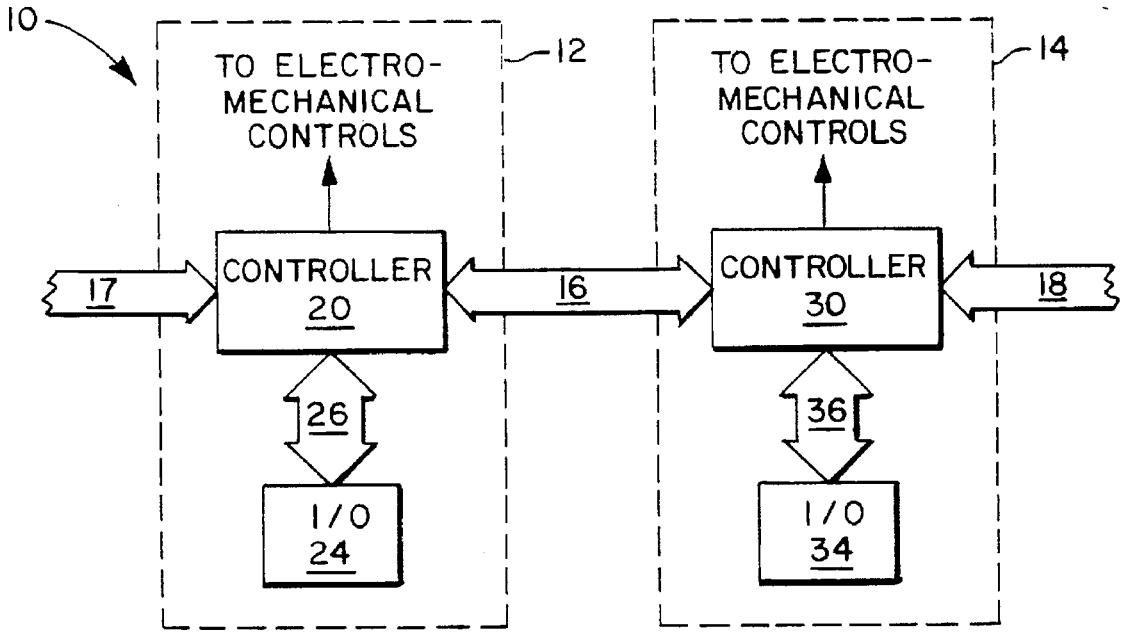
FIG. 1 is a schematic block diagram of an elevator group.

Referring to FIG. 1, an elevator group 10 is comprised of a first elevator 12 and a second elevator 14. Digital communication between the elevators 12, 14 is provided by an interelevator communication link 16 which is implemented by means known to those skilled in the art. The group 10 may also be comprised of other elevators (not shown) which communicate with the first and second elevators 12, 14 via other interelevator links 17, 18. A remote elevator communications interface (not shown), which provides for interfacing the group 10 with a remote master computer, may also be used.

The first elevator 12 is comprised of a microprocessor-based controller 20 which provides signals to electromechanical controls (not shown) for actuating electromechanical devices (not shown) that move an elevator car (not shown). The controller 20 also sends and receives signals to and from elevator input/output devices 24, such as hall and car call buttons, hall lanterns, floor indicators, crowd sensors, etc. via an intraelevator communications link 26, the implementation of which is known to those skilled in the art. The second elevator 14 is similarly configured with a microprocessor based controller 30, input/output devices 34, and an intraelevator communications link 36.

Figure 2:
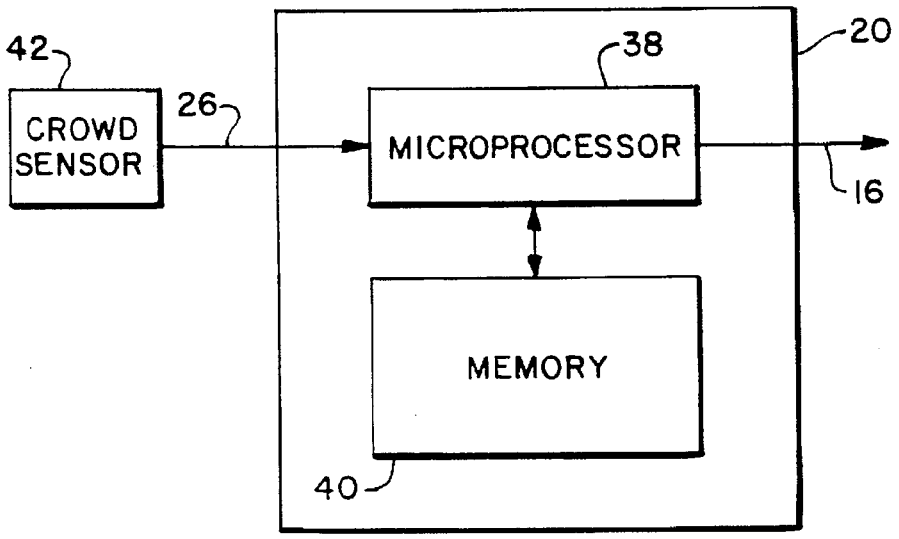
FIG. 2 is schematic block diagram of an elevator controller.

Referring to FIG. 2, the controller 20 in a preferred embodiment is comprised of a microprocessor 38 and a memory 40. The microprocessor 38 cooperates with the memory 40 such that the controller 20 is responsive to a crowd sensor signal that is transmitted by a crowd sensor 42 via the intraelevator communications link 26. The crowd sensor detects the presence of a crowd in a landing hallway and is known to those skilled in the art. The controller 20 implements elevator dispatch programming embedded in the memory 40 that controls the assignment of elevator cars in a building as is described hereinbelow.

Figure 3:
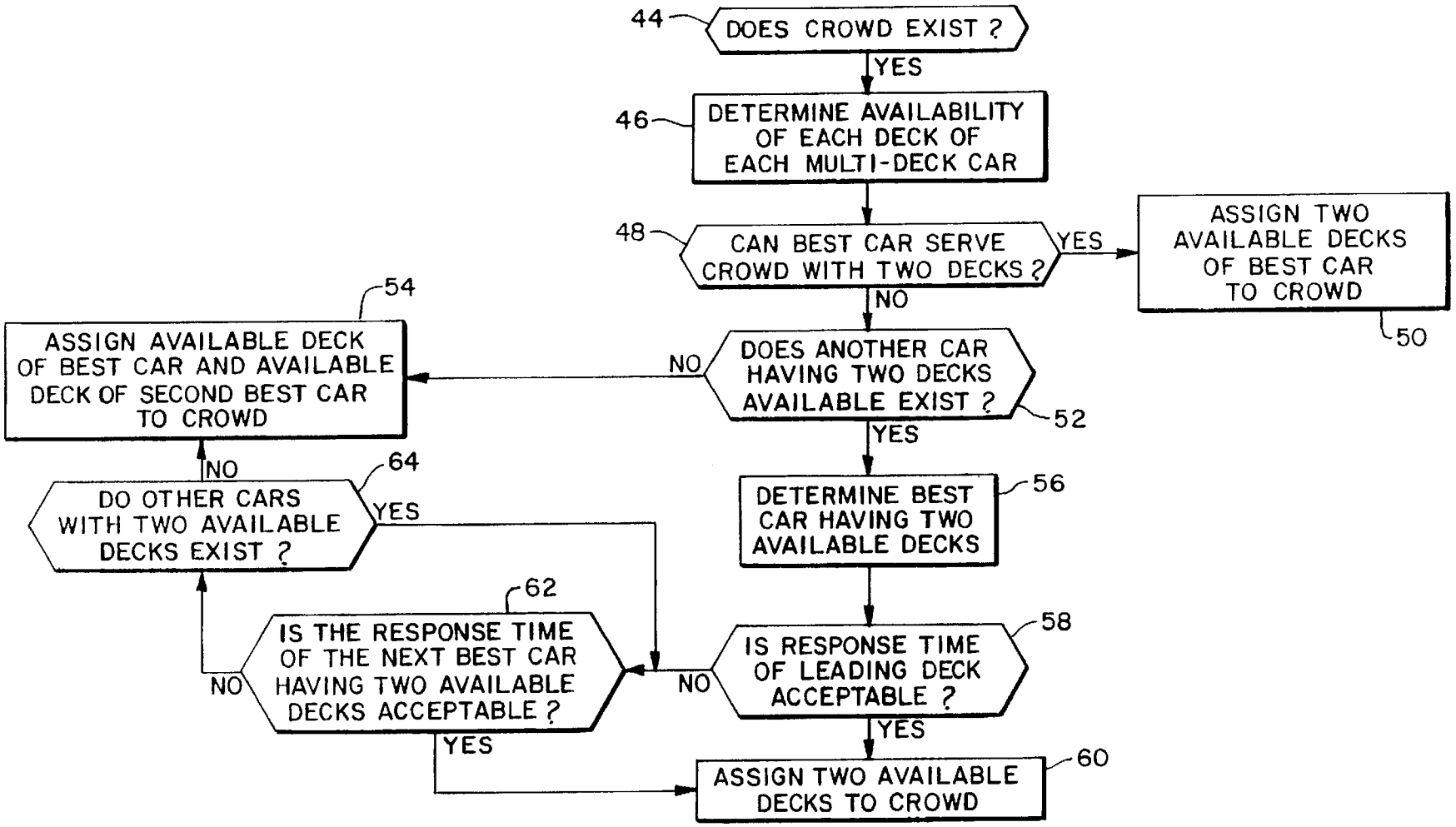
FIG. 3 is a flow diagram of a preferred embodiment of the present invention.

According to the invention, as shown in FIG. 3, a method of assigning a multi-deck elevator car is implemented by the controller 20. Beginning at block 44, the first step performed is to determine if a crowd exists. The presence of the crowd is determined by the controller 20 in response to the crowd sensor signal transmitted by the crowd sensor 42. Alternatively, the controller 20 can predict the crowd by use of a number of different known methods.

In step 46, the controller 20 determines the availability of the decks of each multi-deck car; this information is stored in memory 40 for use in later steps.

The controller 20, in step 48, determines if a best elevator car can serve the crowd with two decks. The best elevator car is defined as the elevator car which produces the least detrimental effect on service and waiting times for the passengers in the building if the elevator car is assigned to the floor where the crowd exists. Determining the best car may be used for other dispatching techniques and is described below.

In a preferred embodiment, the best elevator car is determined by using a Relative System Response ("RSR") approach. In the RSR approach, the car to hall travel time is expressed in terms of various time related penalties. These penalties are added together and summed with various penalties that penalize undesirable operating conditions. Bonuses are given for desirable operating situations and these are subtracted from the sum of penalties resulting in the RSR value. These values are calculated for each car for a given hall call and the elevator car with the minimum RSR value is designated as the best elevator car and is assigned to answer the hall call. One known method of determining the best car using a RSR approach is disclosed in commonly assigned U.S. Pat. No. 5,024,295, issued Jun. 18, 1991, entitled "Relative System Response Elevator Dispatcher System Using Artificial Intelligence To Vary Bonuses and Penalties" to Thanagavelu. However, one skilled in the art will recognize that other methods of determining the best elevator car may be used without departing from the spirit or scope of the invention.

If the best elevator car is able to serve the crowd with two decks then the best elevator car is assigned to service the crowd in step 50. The best elevator car makes one stop for each of the two available decks; thus, the crowd is serviced without the need to remove multiple elevator cars from other calls in the elevator system. This reduces the detrimental effect on service and waiting times caused by dispatching several elevator cars to landings where a crowd exists, reduces the number of car assignments if a false crowd is detected, minimizes the waiting time for a second car during a crowd condition and minimizes passenger movement in the hallway.

However, the best elevator car may not be a multi-deck car or may not have more than one available deck to service the crowd. In either case, in step 52, the controller 20 determines if other elevator cars have at least two decks available. If no other elevator cars have two decks available then the controller 20 assigns the available deck of the best elevator car and the available deck of a next best available elevator car to service the crowd in step 54. In one embodiment, the best available elevator car and the next best available elevator car are determined using an RSR approach as described above. For example, the best available car is an elevator car which has the lowest RSR value of a set of available elevator cars. The next best available elevator car has the next lowest RSR value of a set of available elevator cars.

If the controller 20, in step 52, determines that other elevator cars have two decks available then the controller 20 determines a best elevator car from a set of elevator cars having at least two available decks. In step 58, the controller determines if the response time of a leading deck of the best elevator car having two available decks is acceptable. The leading deck is defined as a deck of a multi-deck elevator car that would be first to arrive at the landing where the crowd exists if the multi-deck elevator car were to service the crowd. The response time is defined as the amount of time for a deck to reach the floor where the crowd exists. In one embodiment, the response time of the leading deck is acceptable if the response time is less than or equal to an average response time for current traffic. However, one skilled in the art will recognize that other suitable criteria may be chosen in determining whether the response time is acceptable without departing from the spirit or scope of the invention.

If the response time of the leading deck of the best elevator car having two available decks is acceptable then the controller 20, in step 60, assigns the two available decks of the best elevator car to serve the crowd.

If the response time of the leading deck of the best elevator car having two available decks is not acceptable then the controller 20, in step 62, determines if the response time of a next best elevator car having two available decks is acceptable. The next best elevator car having two available decks is determined, in one embodiment, by the RSR approach described above. If the response time of the next best elevator car having two available decks is acceptable then the controller 20 assigns the two available decks to the landing where the crowd exists.

If the response time of the next best elevator car is not acceptable then the controller 20, in step 64, determines if other elevator cars with two available decks exist. If no other elevator cars with two available decks exist, the controller 20 assigns the available deck of the best elevator car and the available deck of a next best available car to service the crowd in step 54. However, if the controller 20 in step 64 determines that other elevator cars two available decks exist then the controller 20 again moves to step 62 to determine if the response time of the leading deck of a next best elevator car having two available decks is acceptable. The controller 20 will remain in this loop until either a next best car having two available decks is found or there are no other elevator cars with two decks available.

Thus, the present invention provides the advantages reducing the detrimental effect on service and waiting times caused by dispatching several elevator cars to landings where a crowd exists, reducing the number of car assignments if a false crowd is detected, minimizing the waiting time for a second car during a crowd condition and minimizing passenger movement in the hallway.

Various changes to the above description may be made without departing from the spirit and scope of the present invention as would be obvious to one of ordinary skill in the art of the present invention.

What is claimed is:

1. In an elevator dispatching system controlling the assignment of elevator cars in a building, a method of assigning a multi-deck elevator car, said method comprising the steps of:

determining if a crowd exists at a floor in the building;

determining a best elevator car;

determining if two decks of the best elevator car are available, if it is determined that the crowd exists at the floor in the building; and assigning the two available decks of the best elevator to the floor where the crowd exists, if it is determined that two decks of the best elevator car are available; wherein, the best elevator car makes one stop for each of the two available decks at the floor where the crowd exists.

2. In an elevator dispatching system controlling the assignment of elevator cars in a building, a method of assigning a multi-deck elevator car as recited in claim 1, said method further comprising the steps of:

determining if another elevator car has two available decks, if it is determined that two decks of the best car are not available;

determining a best car having two available decks, if said another elevator car having two available decks exists;

determining if a response time of the best car having two available decks is acceptable; and assigning the two available decks of the best elevator car having two available decks to the floor where the crowd exists, if the response time of the best car having two available decks is acceptable; wherein, the best elevator car having two available decks makes one stop for each of the two available decks at the floor where the crowd exists.

3. In an elevator dispatching system controlling the assignment of elevator cars in a building, a method of assigning a multi-deck elevator car as recited in claim 2, said method further comprising the steps of:

determining if a next best elevator car having two decks available exists, if it is determined that the response time of the best car having two available decks is not acceptable;

determining if a response time of the next best elevator car having two available decks is acceptable, if the next best elevator car having two available decks exists; and assigning the two available decks of the next best elevator car having two decks to the floor where the crowd exists, if the response time of the next best elevator car having two available decks is acceptable; wherein, the next best elevator car having two available decks makes one stop for each of the two available decks at the floor where the crowd exists.

4. In an elevator dispatching system controlling the assignment of elevator cars in a building, a method of assigning a multi-deck elevator car, said method comprising the steps of:

determining if a crowd exists at a floor in the building;

determining a set of elevator cars having at least two available decks;

determining a best elevator car from the set of elevator cars having at least two available decks, if the crowd exists at the floor; and assigning the two available decks of the best elevator to the floor, wherein the best elevator car makes one stop for each of the available decks at the floor.

* * * * *